United States Patent [19]

Freeman

[11] Patent Number: 4,995,655

[45] Date of Patent: Feb. 26, 1991

[54] MAGNETIC DOOR STOP

[76] Inventor: Richard A. Freeman, P.O. Box 102, Climax, N.C. 27233

[21] Appl. No.: 519,812

[22] Filed: May 7, 1990

[51] Int. Cl.[5] ..... E05C 19/16

[52] U.S. Cl. ..... 292/251.5; 292/DIG. 19

[58] Field of Search ..... 292/251.5, DIG. 19, 292/DIG. 15

[56] References Cited

U.S. PATENT DOCUMENTS

| | | | |
|---|---|---|---|
| 2,519,435 | 8/1950 | Byrd, Jr. | 292/251.5 |
| 2,530,363 | 11/1950 | Johnson et al. | 292/DIG. 19 |
| 2,761,718 | 9/1956 | Tool | 292/251.5 |
| 2,815,236 | 12/1957 | Lowinski | 292/251.5 |
| 3,025,559 | 3/1962 | Basinger | 292/251.5 |
| 3,100,664 | 8/1963 | Duval | 292/251.5 |
| 3,163,453 | 12/1964 | Stephens | 292/251.5 |
| 3,578,370 | 5/1971 | Greytok | 292/251.5 |
| 3,675,959 | 7/1972 | Hansen et al. | 292/DIG. 19 |

FOREIGN PATENT DOCUMENTS

| | | | |
|---|---|---|---|
| 155313 | 7/1956 | Sweden | 292/251.5 |

*Primary Examiner*—Eric K. Nicholson

*Attorney, Agent, or Firm*—Leon Gilden

[57] ABSTRACT

An apparatus including a base member fixedly mounted to a wall support surface, including a shaft member extending orthogonally relative to the base member, with a cylindrical magnetic tip mounted thereon. The cylindrical magnetic tip is cooperative with a magnetically attractive cylindrical plate member mounted in an aligned relationship to an associated door aligned with the rod and magnetic tip. Modifications of the invention include a magnetic cylindrical tip including a threaded shank securable to a resilient pad of a door stop projection cooperative with a cylindrical tip. Further, the invention includes a cylindrical sleeve overlying the resilient projection provided with an encased magnetic member therewithin to provide a buffering action and minimize marring of an associated door in use.

3 Claims, 4 Drawing Sheets

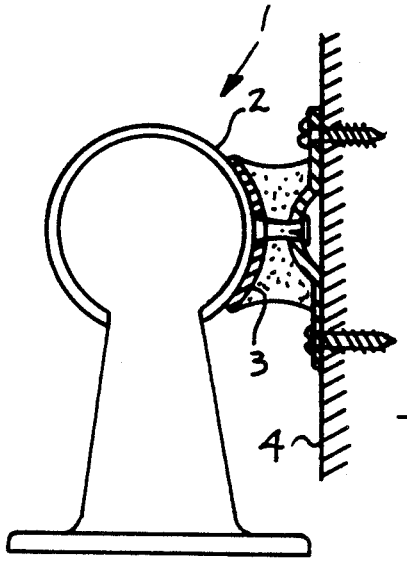
FIG 1
PRIOR ART
FIG 2
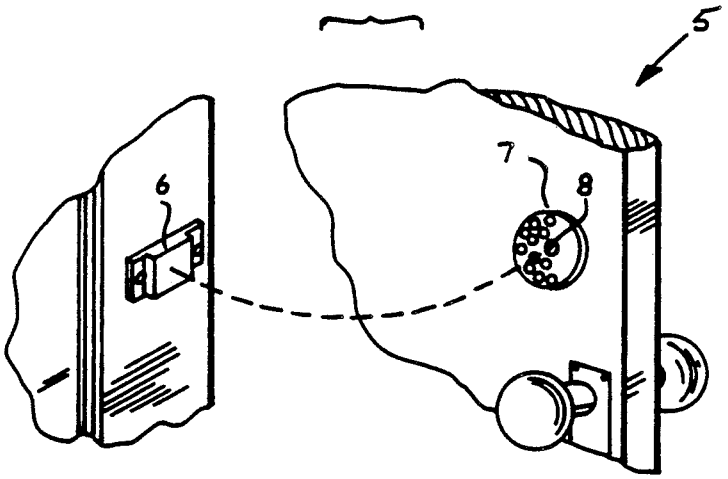
PRIOR ART

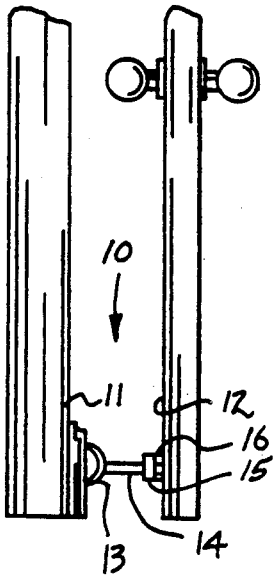
FIG 3
FIG 4
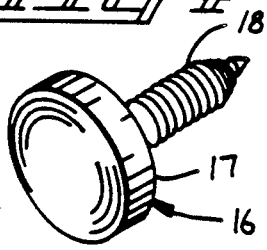
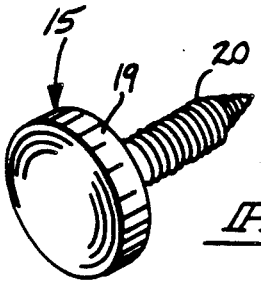
FIG 5

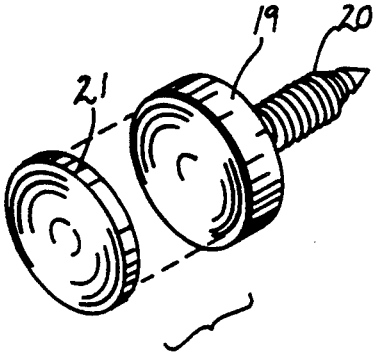
Fig 6
Fig 7
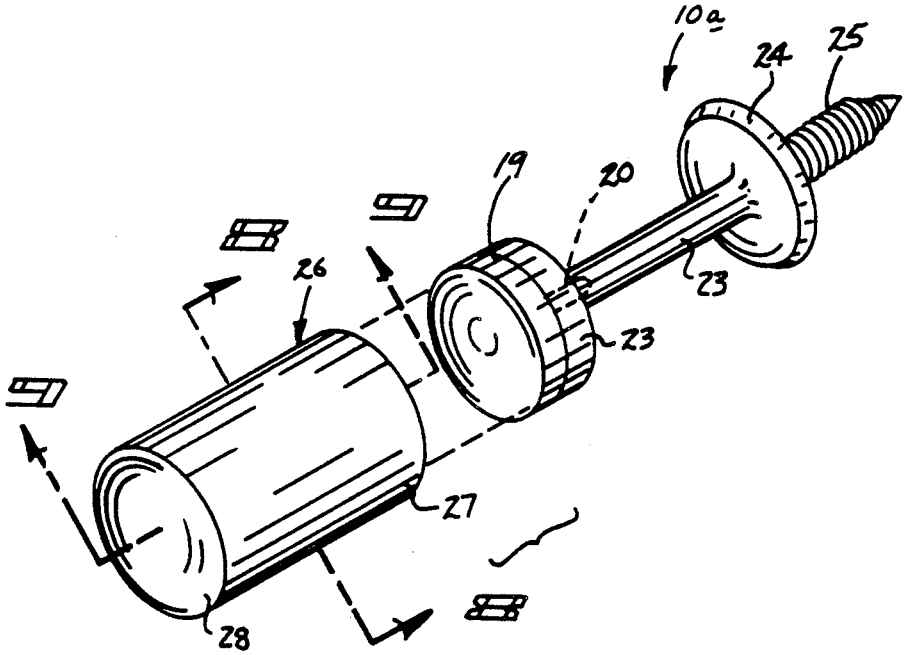

MAGNETIC DOOR STOP

BACKGROUND OF THE INVENTION

1. Field of the Invention

The field of invention relates to door abutment apparatus, and more particularly pertains to a new and improved magnetic door stop apparatus wherein the same permits magnetic positioning of a door relative to an associated wall in addition to a bumper organization in use.

2. Description of the Prior Art

The prior art has provided various abutment members and door positioning members for use in maintaining a door in a predetermined orientation relative to a wall or support surface. Examples of the prior art include U.S. Pat. No. 3,734,553 to Sugasawara wherein a spherical metallic member is mounted to a base for positioning onto a floor cooperative with a convex magnetically attractive member mounted to an associated door.

U.S. Pat. No. 3,539,214 to Fisher utilizes a rotatable plate member utilizing a plurality of apertures therewithin to permit variance of magnetic attraction of a magnetic holding member relative to the plate.

U.S. Pat. No. 3,701,557 to Centofante sets forth an adjustable door stop including a knurled sleeve threaded onto a cylinder, with an extended rubber projection mounted thereon for abutment with a door.

U.S. Pat. No. 4,669,766 to Hanchett provides for a door holding mechanism utilizing a magnetic coil mounted within a cylindrical housing and means for pivotally mounting the cylindrical housing onto an associated wall, with a door plate mounted on the door to magnetically attract the door to the cylindrical housing.

U.S. Pat. No. 4,505,502 to Tomita sets forth a magnetic door catch to position a door in an open position, wherein a cup-shaped metallic member is supported for universal rotary motion in a plastic housing mounted on the door for cooperation with an associated attractive member mounted on an associated wall surface.

As such, it may be appreciated that there continues to be a need for a new and improved magnetic door stop wherein the same addresses both the problems of ease of use, as well as effectiveness in construction to provide a conveniently utilized member that may also be retrofitted to an existing door and wall structure, as well as existing door abutment apparatus and in this respect, the present invention substantially fulfills this need.

SUMMARY OF THE INVENTION

In view of the foregoing disadvantages inherent in the known types of magnetic door stop apparatus now present in the prior art, the present invention provides a magnetic door stop wherein the same permits ease of securement to an associated door and wall structure to enable maintaining of a door in an open position relative to a door portal. As such, the general purpose of the present invention, which will be described subsequently in greater detail, is to provide a new and improved magnetic door stop which has all the advantages of the prior art door stop apparatus and none of the disadvantages.

To attain this, the present invention provides an apparatus including a base member fixedly mounted to a wall support surface, including a shaft member extending orthogonally relative to the base member, with a cylindrical magnetic tip mounted thereon. The cylindrical magnetic tip is cooperative with a magnetically attractive cylindrical plate member mounted in an aligned relationship to an associated door aligned with the rod and magnetic tip. Modifications of the invention include a magnetic cylindrical tip including a threaded shank securable to a resilient pad of a door stop projection cooperative with a cylindrical tip. Further, the invention includes a cylindrical sleeve overlying the resilient projection provided with an encased magnetic member therewithin to provide a buffering action and minimize marring of an associated door in use.

My invention resides not in any one of these features per se, but rather in the particular combination of all of them herein disclosed and claimed and it is distinguished from the prior art this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent construction insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved magnetic door stop which has all the advantages of the prior art door stop apparatus and none of the disadvantages.

It is another object of the present invention to provide a new and improved magnetic door stop which may be easily and efficiently manufactured and marketed.

It is a further object of the present invention to provide a new and improved magnetic door stop which is of a durable and reliable construction.

An even further object of the present invention is to provide a new and improved magnetic door stop which is susceptible of a low cost of manufacture with regard to both materials and labor, and when accordingly is then susceptible of low prices of sale to the consuming public, thereby making such magnetic door stops economically available to the buying public.

Still yet another object of the present invention is to provide a new and improved magnetic door stop which provides in the apparatuses and methods of the prior art some of the advantages thereof, while simultaneously overcoming some of the disadvantages normally associated therewith.

Still another object of the present invention is to provide a new and improved magnetic door stop wherein the same includes aligned cylindrical members mounted on respective door and wall surface portions to permit selective maintenance of an associated door in an opened configuration relative to a door portal and to maintain the same against an associated wall in a magnetically attractive relationship.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an orthographic view taken in elevation of a prior art magnetic door positioning apparatus.

FIG. 2 is an isometric illustration of a further prior art examples of a magnetic door positioning apparatus.

FIG. 3 is an orthographic view taken in elevation of the instant invention in association with a door and wall organization.

FIG. 4 is an isometric illustration of a magnetic member utilized by the instant invention.

FIG. 5 is an isometric illustration of a magnetically attractive member utilized by the instant invention.

FIG. 6 is an isometric illustration of the magnetic member utilizing a buffer member mounted thereon.

FIG. 7 is an isometric illustration, somewhat exploded, of the instant invention utilizing a sleeve member mounted thereon.

DESCRIPTION OF THE PREFERRED EMBODIMENT

Figure 8B:
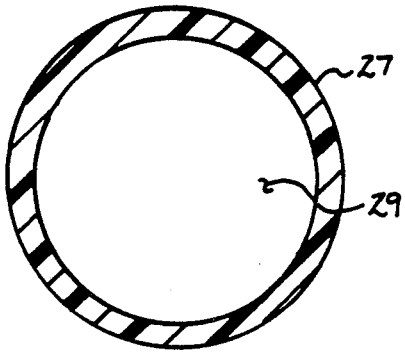
FIG. 8 is an orthographic view taken along the lines 8—8 of FIG. 7 in the direction indicated by the arrows.
Figure 9:
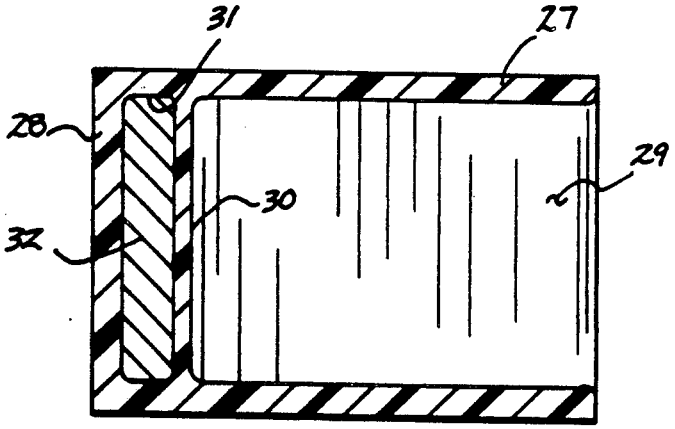
FIG. 9 is an orthographic view taken along the lines 9—9 of FIG. 7 in the direction indicated by the arrows.

With reference now to the drawings, and in particular to FIGS. 1 to 9 thereof, a new and improved magnetic door stop embodying the principles and concepts of the present invention and generally designated by the reference numerals 10 and 10*a* will be described.

FIG. 1 illustrates a prior art magnetic door positioning apparatus 1 including a spherical magnetic member 2 mounted overlying a support stand to a floor support surface, wherein a magnetic concave member is mounted to a bracket portion that in turn is secured to an associated door 4 to maintain the door in an open configuration. FIG. 2 illustrates a further prior art door positioning apparatus 5, wherein a magnetic attractive member 6 is cooperative with a plate 7 rotatably mounted about an axis 8 formed with apertures therethrough to varying magnetic attraction of the plate 7 relative to the member 6 upon selective rotation of the plate member 7 about the axis 8.

More specifically, the magnetic door stop apparatus 10 of the instant invention essentially comprises positioning the apparatus 10 in a fixed relationship between a rigid vertical wall 11 and a pivotally mounted door 12 to permit positioning the door 12 in a fixed orientation relative to the wall 11. An annular base member 13 is fixedly mounted to the wall 11, including an extension rod 14 fixedly and integrally mounted to the base 13 and orthogonally oriented relative to the wall 11. The extension rod 14 includes on its forward terminal end a permanent magnetic projection 15 of a cylindrical configuration. The cylindrical configuration minimizes damage to objects and individuals that are directed into inadvertent contact with the projection 15 to minimize damage to such objects and individuals. A magnetically attractive cylindrical plate 16 is fixedly mounted to the door 12 in coaxial alignment with the magnetic projection 15 when the door 12 is in an adjacent spaced relationship to the wall 11, as illustrated in FIG. 3.

FIG. 4 illustrates the magnetically attractive plate 16 formed with a cylindrical head 17, with a first threaded shank 18 mounted integrally and orthogonally relative to a rear surface of the head 17 for securement of the plate 16 to the door 12, as illustrated. FIG. 5 notes the use of the permanent magnetic projection 15 configured as a cylindrical magnetic head 19, including a second threaded shank 20 integrally and orthogonally mounted to a rear surface of the magnetic head 19.

FIG. 6 illustrates the magnetic cylindrical head 19 including a foam cylindrical pad 21, including an adhesvive rear surface thereon mounted to the head 19 to minimize impact of contact between the cylindrical head 17 and the magnetic cylindrical head 19. It is noted that the foam pad 21, the magnetic head 19, and the cylindrical head 17 are each defined by an equal predetermined diameter.

FIG. 7 illustrates a modified magnetic door stop 10*a*, wherein a resilient bumper 22 of the predetermined diameter includes a support shaft 23 orthogonally and coaxially mounted to a rear surface of the resilient bumper 22 extending rearwardly thereof fixedly and coaxially mounted to a support base 24 that includes a third threaded shank 25 coaxially mounted to the base 24 and extending rearwardly thereof, wherein the shank 25, the support shaft 23, and the resilient bumper 22 are all coaxially aligned relative to one another. The magnetic cylindrical head 19 is mounted to the resilient bumper 22 utilizing the second threaded shank 20 to secure the magnetic cylindrical head thereon in coaxially aligned relationship with the bumper 22. A cylindrical sleeve 26 is defined by an internal diameter substantially equal to the predetermined diameter of the magnetic head 19 and the bumper 22. The sleeve 26 is formed of a polymeric semi-rigid material to provide impact absorbing characteristics to the sleeve 26 in its impact with the associated magnetically attractive plate 16, as illustrated in FIG. 4 for example. The sleeve 26 includes a cylindrical skirt 27 with a cylindrical head portion 28 coaxially mounted to a forward end of the skirt 27. A cylindrical web 30 is coaxially mounted interiorly of the skirt 27 rearwardly of the head 28 defining a cylindrical cavity between the web 30 and the head 28. A cylindrical magnet 32 is accordingly captured within the cavity 31. The magnet 32 is arranged in a pole attractive relationship to attract the magnet 32 to the magnet cylindrical head 19. The use of the sleeve 26, in addition to providing impact characteristics to the organization, further permits special adjustment of the door 12 to the wall 11 and rearwardly extending skirt 27 providing an enlarged impact surface to minimize damage to an individual or object in engagement with the skirt 27 during its positioning about the bumper 22.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A magnetic door stop apparatus to permit selective securement of a pivotal door relative to a vertical wall, wherein the apparatus comprises, a base member securable to the wall including an extension rod coaxially and integrally mounted to the base member extending orthogonally thereof, including a bumper means which includes a permanent magnet, and a magnetically attractive plate member selectively mounted to the door in coaxial alignment with the bumper means to effect attraction of the bumper means to the plate member, and selectively secure the door in a spaced relationship relative to the wall, and wherein the plate member includes a cylindrical head defined by a predetermined diameter, and a first threaded shank coaxially and integrally mounted to a rear surface of the cylindrical head extending rearwardly of the cylindrical head for securement to the door, and wherein the bumper means includes a resilient cylindrical bumper integrally and orthogonally mounted to the extension rod, wherein the resilient bumper is of a diameter equal to the predetermined diameter, and the base member includes a second threaded shank integrally and coaxially aligned with the extension rod extending rearwardly of the base member for securement within the wall, and wherein the bumper means further includes a magnetic cylindrical head, the magnetic cylindrical head defined by a magnetic cylindrical head diameter equal to the predetermined diameter and includes a third threaded shank orthogonally and coxially mounted to the magnetic cylindrical head extending rearwardly thereof and threadedly received within the resilient bumper coaxially aligned with the extension rod, and the resilient bumper in contiguous coaxially aligned relationship to the magnetic head, and wherein the bumper means further includes a cylindrical sleeve defined by a cylindrical skirt including an internal cylindrical cavity therewithin, wherein the internal cylindrical cavity includes cavity diameter equal to the predetermined diameter, and the cylindrical sleeve includes a cylindrical head member mounted to a forward end of the sleeve, and a cylindrical web mounted interiorly of the cylindrical cavity spaced from the head defining a magnet cavity between the web and the cylindrical head, and a magnet member mounted within the magnet cavity.

2. An apparatus as set forth in claim 1 wherein the magnetic member is in a reverse pole relationship to the magnetic head mounted on the resilient bumper to magnetically attract the magnetic member to the magnetic head.

3. An apparatus as set forth in claim 2 wherein the cylindrical skirt extends rearwardly of the resilient bumper, wherein the cylindrical sleeve is mounted in surrounding contiguous relationship to the cylindrical magnetic head.

* * * * *